US006925916B2

(12) United States Patent
Duggins et al.

(10) Patent No.: US 6,925,916 B2
(45) Date of Patent: Aug. 9, 2005

(54) TWO STAGE PUNCH PRESS ACTUATOR WITH OUTPUT DRIVE SHAFT POSITION SENSING

(75) Inventors: Terrence P. Duggins, Watertown, SD (US); Robert L. Hughes, Minneapolis, MN (US); Edward L. Schwarz, Minneapolis, MN (US)

(73) Assignee: PCPS Limited Partnership, Watertown, SD (US)

( * ) Notice: Subject to any disclaimer, the term of this patent is extended or adjusted under 35 U.S.C. 154(b) by 0 days.

(21) Appl. No.: 10/132,299

(22) Filed: Apr. 26, 2002

(65) Prior Publication Data

US 2002/0112578 A1 Aug. 22, 2002

Related U.S. Application Data

(62) Division of application No. 09/517,926, filed on Mar. 3, 2000, now Pat. No. 6,418,824.

(51) Int. Cl.[7] ..... B26D 1/00; B26F 1/14

(52) U.S. Cl. ..... 83/13; 83/76.7; 83/543; 83/639.5; 83/684; 83/DIG. 1

(58) Field of Search ..... 83/13, 543, 684, 83/58, DIG. 1, 76.7, 639.5, 639.1; 100/35, 39, 269.1, 269.08, 269.07, 269.06; 60/563, 565, 560

(56) References Cited

U.S. PATENT DOCUMENTS 1,960,548 A * 5/1934 Pfeiffer ..... 426/512
2,030,966 A * 2/1936 Crane et al. ..... 60/429
2,494,018 A * 1/1950 Urquhart ..... 83/167
2,587,571 A * 2/1952 Lombard ..... 60/538
2,821,251 A * 1/1958 Borke ..... 83/63
3,186,173 A * 6/1965 Hogg ..... 60/563
3,786,976 A 1/1974 Murphy, II (Continued)

FOREIGN PATENT DOCUMENTS

JP 05104298 A * 4/1993 ..... B30B/13/00

*Primary Examiner*—Boyer Ashley
*Assistant Examiner*—Isaac Hamilton
(74) *Attorney, Agent, or Firm*—Posz Law Group, PLC

(57) ABSTRACT

A press for forming a workpiece with a tooling set includes an actuator assembly carrying a movable half or punch of the tooling set and having a two phase operation. In the first phase the actuator provides relatively low force in moving the punch to an intermediate position in close proximity to the workpiece. A sensor detects the position of the punch, and when the punch reaches the intermediate position provides a continue signal. The second phase of actuator operation is conditioned on occurrence of the continue signal, and uses normal high force to press the movable tooling half against the workpiece to complete the operation. The low force first phase allows obstructions of any kind to stop movement of the punch during the first phase before high force applied to the actuator may cause damage or injury to the obstruction. In a preferred embodiment the actuator assembly has hydraulic operation.

13 Claims, 5 Drawing Sheets

U.S. PATENT DOCUMENTS 3,951,025 A 4/1976 White
4,116,122 A 9/1978 Linder et al.
4,166,415 A 9/1979 Spanke et al.
4,426,177 A 1/1984 Perry
4,466,317 A 8/1984 Ikeda
4,484,119 A 11/1984 Kerr
4,696,227 A * 9/1987 Van Buskirk ..... 100/90
4,823,658 A 4/1989 Spicer
4,844,114 A * 7/1989 Moberg et al. ..... 137/115.21
4,864,914 A * 9/1989 LeMoine ..... 91/29
4,977,804 A 12/1990 Naito
4,982,638 A * 1/1991 Brussel ..... 83/614
5,038,598 A * 8/1991 Pitzer ..... 72/453.02
5,042,336 A 8/1991 Capps
5,303,641 A * 4/1994 Gallandere ..... 100/35
5,588,344 A 12/1996 Chun
5,706,711 A 1/1998 Ito
5,931,070 A 8/1999 Miyajima et al.
5,983,761 A 11/1999 Sasaki et al.
6,000,311 A 12/1999 Katoh et al.
6,012,370 A 1/2000 Kobayashi
6,041,683 A * 3/2000 Timperi et al. ..... 144/34.1
6,125,834 A 10/2000 Ciccarelli et al.
6,128,987 A 10/2000 Nakagawa et al.
6,279,370 B1 * 8/2001 Awad ..... 72/453.02

* cited by examiner

TWO STAGE PUNCH PRESS ACTUATOR WITH OUTPUT DRIVE SHAFT POSITION SENSING

The present application is a division of application Ser. No. 09/517,926, filed on Mar. 3, 2000, entitled TWO STAGE PUNCH PRESS ACTUATOR WITH OUTPUT DRIVE SHAFT POSITION SENSING, now U.S. Pat. No. 6,418,824, issued Jul. 16, 2002.

BACKGROUND OF THE INVENTION

Punch or stamping presses are a staple of manufacturing operations for products formed from workpieces such as metal sheets, rods, bars, etc. With properly designed tooling sets, punch presses can be used for a variety of manufacturing process operations including cutting, forming, drawing, shaping, and assembling. Punch presses come in sizes ranging from a meter or less in height to several meters in height, and can develop force ranging from hundreds to many thousands of kilograms.

The structure of a punch press includes a frame with a table and with a drive rod or shaft mounted on the frame. Force applied to the rod causes the rod to translate toward and away from the table. The table supports a fixed half of the tooling set called a die. The drive rod carries at an end adjacent to the die, a movable half of the tooling set called a punch and designed to closely mate or engage with the die. Punch presses are designed so that tooling can be easily replaced. An actuator mounted on the frame applies a large amount of force to the drive rod during a power stroke to move the drive rod and the punch carried by it toward the table. During each power stroke the actuator drives the punch toward the die to mate with the fixed die, with a workpiece between the punch and die. As the actuator forces the punch and die together, cooperating patterns in the punch and die bend, cut, draw, thin, etc. the workpiece as desired to create the intended product. Some tooling sets are designed with a number of stations so that the workpiece may be shifted sequentially to each of the stations between pressing events to complete the product.

The tooling set is made from tool steel or other hard, durable material. The tooling set must have precision dimensions and its halves are designed to mate with great accuracy as well as to operate without failure for many cycles under the high forces generated by the press. In fact, tool making is itself a recognized craft, with those having such skill in great demand. A tooling set must be designed to be compatible with the press for which it is intended. Design considerations include the amount of force each pressing operation requires and the amount of force the press can develop. By designing the tooling set for compatibility with the press and workpiece, a wide variety of products can be produced efficiently and economically.

The actuator traditional press designs use includes a heavy flywheel mounted for rotation on the frame in combination with a mechanical linkage and a clutch to develop and convert flywheel momentum to force applied to the drive rod. An electrical motor spins the flywheel up to a design speed. After the flywheel is spinning at its design speed, the operator engages the clutch, transferring the flywheel momentum to the mechanical linkage. The mechanical linkage applies the flywheel momentum to the drive rod to force the die halves to mate. On continuing rotation of the flywheel the linkage engages the drive rod to lift the punch from the die, allowing the operator to remove the finished workpiece. It is also possible to provide for a spring which is compressed during the power stroke, to provide for returning the drive rod once the clutch disengages.

The following is well known, but is helpful to clearly define a number of terms which will be frequently used hereafter, and to explain the basics of hydraulic cylinder operation. We use the term "hydraulic cylinder" or more conveniently, "cylinder" here to mean a hydraulic device for converting a flow of pressurized hydraulic fluid to linear mechanical motion, or for converting linear mechanical motion to a flow of pressurized hydraulic fluid. A cylinder comprises a housing having internal walls defining a cylindrical bore essentially closed at one end and open at the other, and with a port in the closed end through which pressurized hydraulic fluid flows. A piston which fits closely to and slides within the bore, defines a cylindrical pressure chamber between itself and the closed end of the bore. The pressure chamber is completely filled with hydraulic fluid. The volume of both the pressure chamber and the hydraulic fluid within the chamber changes as the piston slides within the bore. A piston rod is attached to the piston to transfer force between the piston and an external machine. When a cylinder operates in power mode, pressurized hydraulic fluid is forced into the pressure chamber through the port during a power stroke. During a power stroke, the piston slides linearly from a retracted to an extended position as pressurized hydraulic fluid flows into the chamber. A hydraulic pump of some kind provides the pressurized hydraulic fluid to the chamber.

Newer punch press designs use a hydraulic cylinder as the actuator, and the invention here forms an improvement to these hydraulic presses. The pump which supplies hydraulic fluid to the cylinder is attached to the frame along with the valves and other components of the hydraulic actuator system. Often the pump comprises a hydraulic cylinder operating in pump as opposed to force mode. The pump can draw its energy to operate from a compressed air source.

Of course, some mechanism must be provided for a hydraulic press to restore the piston to its retracted position after a power stroke. For hydraulic actuators, pneumatic or hydraulic pressure applied to the piston on the side opposite the pressure chamber can be used to force the piston to its retracted position. A spring can also be used to provide the retraction force.

In some designs the hydraulic "pump" for a hydraulic press's actuator comprises a so-called air over oil cylinder. An air over oil (AOO) cylinder has a piston which has a compressed air pressure chamber on one end and a hydraulic pressure chamber on the other end. High pressure air entering the air chamber drives the piston to force hydraulic fluid out of the hydraulic chamber and into the actuator hydraulic cylinder. By changing diameters of the pistons appropriately, the force provided by the compressed air can be greatly increased at the output of the hydraulic cylinder. An AOO cylinder-type hydraulic pump provides a moderate amount of high pressure hydraulic fluid inexpensively and with easily controlled pressure.

We find that traditional mechanical actuators have a number of problems in their operation. Among the problems are double strikes, faulty tool alignment, and operator risk. Double strikes for a mechanical press arise when a clutch improperly or unexpectedly applies force to the drive rod to mate the punch with the die without deliberately engaging the clutch. Typically, double strikes occur as the result of wearing or faulty adjustment of the clutch parts. Punch press clutches transfer large amounts of force and operate in dirty and otherwise hostile environments, so it is not surprising that the clutch mechanisms deteriorate with time. In the best of situations, proper maintenance prevents this deterioration, but in the real world proper maintenance does not always occur. And of course unseen and catastrophic failure of critical parts can also lead to double strikes.

Double strikes have the potential to be dangerous. If the operator's hand is between the punch and die for the purpose of removing the finished workpiece from the die, a double strike may smash the hand with obvious potential for serious injury. A less harmful scenario finds the operator's hand safely out of the danger zone but with the workpiece only partially removed or inserted. A double strike in this situation of course spoils the finished workpiece or workpiece blank, and may even damage the tooling.

Faulty tool alignment is a situation where the punch and die do not properly align. This usually also arises from wear or poor maintenance. The result is potentially to damage or even destroy the punch or die, or perhaps to damage the workpiece. Tooling under high loads has even been known to shatter causing broken parts to strike the operator. Even if there is no injury, the damage or destruction of a tooling set is quite enough harm to justify avoidance.

Operator risk occurs of course in the double strike situation as already mentioned. But even during normal operation, it is possible for an operator to carelessly leave her hand in the danger zone. Further, mechanical presses are extremely noisy, which has the potential for hearing damage to the operator. Ear protection reduces this possibility of harm, but makes it more difficult to speak to the operator, which has its own safety problems of course.

Hydraulic actuators have a number of advantages over mechanical actuators. First of all, there are fewer double strikes because the hydraulic and compressed air subsystems tend to deteriorate more slowly and less catastrophically. For example, a compressed air valve may fail by slowly leaking, which conceivably will give an operator time to shut down the press or at least remove her hand from the danger zone. However, the basic hydraulic actuator design does not absolutely preclude double strikes. For example, a malfunctioning compressed air valve can cause a double strike. Nor does a hydraulic actuator deal either with an operator's hand in the danger zone during normal operation, or with tool misalignment.

As to noise, the hydraulic press appears to be much more acceptable than the mechanical press. A hydraulic actuator is much quieter because the high force impact of a clutch arm striking a force-transferring surface on the drive rod is eliminated.

So the present state of the art is that hydraulic cylinder type actuators provide large forces inexpensively and somewhat more safely than mechanical actuators. For this reason they are becoming quite popular for presses. However, they (and mechanical actuators as well) still have significant disadvantages. The enormous forces which these presses apply to the workpiece have the potential to cause serious operator injury. A number of safety features have been devised to prevent operator injury. While these are usually effective, they tend to slow down production, are not always effective, or can even be defeated by careless or rushed operators. Accordingly, it is fair to say that presently available designs do not completely resolve punch press safety issues.

BRIEF DESCRIPTION OF THE INVENTION

We have invented an improvement to punch presses and other devices such as power operated clamps, which dramatically reduces the potential for injury or damage. Instead of trying to prevent the operator from placing himself within the zone of harm, we have devised a way to detect the presence of unexpected resistance or obstruction during an approach phase of the power stroke. When this unusual resistance or obstruction is detected, the press is prevented from completing the power stroke.

In its broadest embodiment, the invention forms a part of a press having a frame and a table mounted on the frame for supporting a die on which a workpiece is to be placed for forming. An actuator assembly carried on the frame includes a drive rod mounted to slide between a retracted position spaced from the table and an extended position spaced adjacent to the table. While the drive rod slides toward the extended position the drive rod applies force to a punch to press the punch against the workpiece and die to complete the forming operation. The actuator assembly comprises an actuator element having a low force mode of operation responsive to a start signal during which the actuator element applies low force to the drive rod. The actuator element also has a high force mode of operation responsive to a continue signal during which the actuator element applies high force to the drive rod. A position sensor is in operative connection to the drive rod, and provides the continue signal responsive to the drive rod achieving a preselected spacing from the table intermediate between the retracted and extended positions of the drive rod.

We implement our preferred version of the invention in a press having a conventional frame and a table mounted on the frame for supporting a workpiece. A hydraulic actuator is mounted on the frame for carrying and applying force to the punch. The actuator preferably comprises a hydraulic cylinder including an actuator piston sliding within an actuator bore, and an actuator piston rod attached to and projecting or extending from the actuator piston toward the table. The piston rod has an end for transferring force from the actuator piston to the punch and the workpiece. The actuator piston defines between itself and an end of the actuator bore an actuator pressure chamber. A fluid port in flow communication with the actuator pressure chamber allows pressurized hydraulic fluid to enter the pressure chamber. Pressure applied by pressurized fluid to the actuator piston causes the piston to slide between a retracted position with the piston rod end retracted from the table and an extended position with the piston rod end adjacent to the table.

A first fluid source supplies relatively low pressure fluid to the actuator's fluid port responsive to a start signal. A variety of devices such as conventional pumps and hydraulic cylinders can function as the first fluid source. In one preferred embodiment, a first hydraulic cylinder operated by compressed air serves as the first fluid source to provide the low pressure fluid. In this arrangement, selecting the cross section area of the piston in the first cylinder and adjusting the air pressure provided to the first cylinder controls the pressure of the fluid provided to the actuator cylinder.

The position sensor is operatively connected to the actuator piston rod end. The sensor provides the continue signal responsive to the actuator piston rod end achieving a preselected spacing from the table intermediate between the retracted and adjacent positions of the piston rod end. This spacing should be chosen to for the most part eliminate the existence of various types of obstructions to or resistance to the normal movement of the piston rod and the punch carried on it. The force generated by the low pressure hydraulic fluid during the first phase of piston rod movement must be great enough to reliably move the piston rod end toward the table and should be low enough to avoid serious injury or damage to any obstruction resisting movement of the punch during the first phase.

A second fluid source supplies relatively high pressure fluid to the actuator's fluid port responsive to the continue signal. One can see that the second fluid source does not supply high pressure fluid to the actuator fluid port unless the actuator piston rod end has reached the intermediate position. The ability of the rod end to reach this position strongly suggests that there is no obstruction or interference to the movement of the rod end.

The sensor can sense the position of the piston rod end in a variety of ways. The position of the piston rod end can be directly detected. It is also possible to detect the rod end position less directly, for example by measuring the position of the actuator piston. Our preferred first fluid source allows a different mechanism still for detecting position of the actuator piston rod end. This preferred first fluid source is a first hydraulic cylinder having a first piston sliding within a first bore and to which force is applied to pressurize fluid in the first cylinder's pressure chamber. This fluid is provided to the actuator fluid port and pressure chamber to create force on the actuator piston.

We have found there is a predictable and repeatable relationship between the positions of the first piston and the actuator piston. The change in volume of the first cylinder's pressure chamber as the first piston slides between preselected retracted and extended positions within the first bore exactly equals the change caused thereby in the volume of the actuator's pressure chamber. By coordinating the dimensions of the first cylinder and the actuator cylinder, the movement of the first piston between its retracted and extended positions can cause the actuator piston to shift from its retracted position to precisely its intermediate position.

We attach to the first piston a first shaft aligned with the movement of the first piston and projecting from the first bore. The first shaft moves with the first piston and reliably indicates position of the first piston. The sensor in this arrangement comprises a switch having a control arm in contact with the first shaft. The switch has a first conductive state responsive to a first position of the control arm, and a second conductive state responsive to a second position of the control arm. The control arm has the first position when the first piston is between its retracted and extended positions, and the second position when the first piston is at the extended position. The switch conducts the continue signal provided by an external source while in its second conductive state. If an obstruction prevents the first piston from reaching the extended position, the switch will not reach its second conductive state, and therefore the second, high force phase of the power stroke does not occur.

While our presently preferred embodiment uses hydraulic actuation, it is possible that mechanical, pneumatic, or even electrical actuation can be adapted to incorporate the method of our invention. Such an improved method is for operating a press apparatus having a frame and a table mounted on the frame for supporting a die of a tooling set on which may be placed a workpiece. A drive rod is mounted on the frame to move toward and away from the table between retracted and extended positions respectively. The drive rod has an end adjacent to the table for carrying a punch of a tooling set. The drive rod transfers force to the punch. This improved method comprises a first step of providing relatively low force to the drive rod responsive to a start signal. This low force urges the drive rod toward the table. The press apparatus senses position of the drive rod while the drive rod is receiving the low force and moving toward the table. The press apparatus provides a continue signal responsive to the drive rod achieving a preselected position between its retracted and extended positions. In responsive to the continue signal the press apparatus supplies relatively high force to the drive rod. This high force step completes the press operation and forms the workpiece according to the pattern in the tooling set.

An obstruction will prevent the drive rod from reaching the preselected position, which results in no continue signal occurring. If no continue signal occurs, the high force step will not occur. This prevents harm or injury arising from the presence of the obstruction.

DESCRIPTION OF THE PREFERRED EMBODIMENTS

Figure 1:
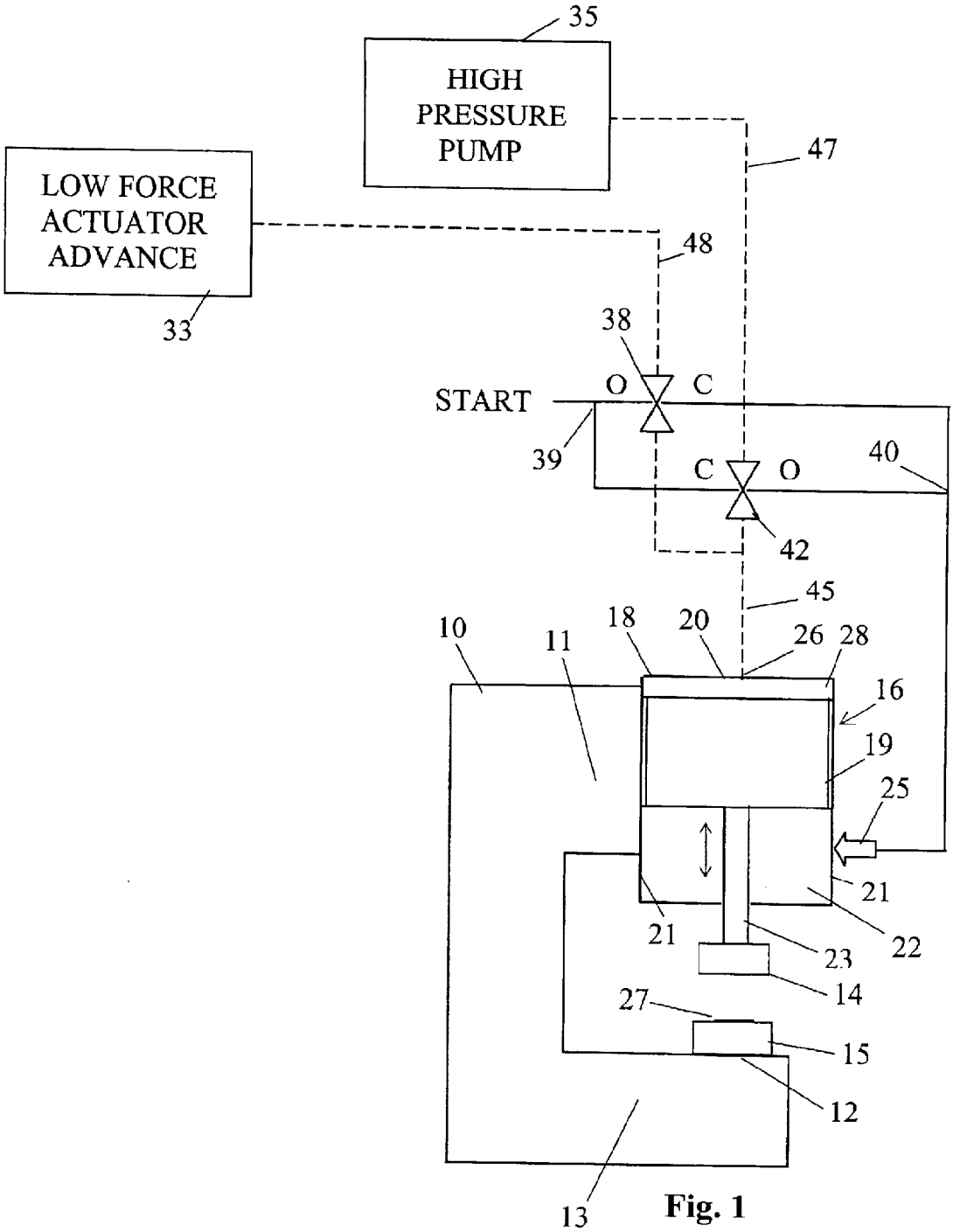
FIG. 1 is a schematic diagram of a generalized or simplified structure of the invention.

The invention as shown in FIG. 1 is substantially simplified as compared to a commercial embodiment. Referring to FIG. 1, the punch press shown there includes a C-shaped frame 10 including an upper arm 11 and a lower arm 13. Lower arm 13 defines on its upper surface a table 12 for supporting a tooling half or die 15. During an operating cycle of the press, a workpiece 27 to be formed rests on die 15. Upper arm 11 supports an actuator element comprising a hydraulic cylinder 16 which is a part of a complete actuator assembly. Cylinder 16 comprises a housing 18 with an internal cylindrical (and usually circular cross section) bore 22 defined by cylindrical walls 21 and closed by an end wall 20. A piston 19 is mounted to slide along a linear piston path within walls 21 as suggested by the double arrow shown. Piston 19 has a fluid-tight fit with walls 21 while sliding along the piston path. Piston 19 along with end wall 20 and side walls 21 collectively define a pressure chamber 28. A fluid port at 26 allows pressurized fluid supplied by a pipe 45 to enter and exit from pressure chamber 28. A piston rod 23 is connected to the bottom of piston 19 and is aligned with the piston path. The lower end of rod 23 supports a punch or movable die half 14 which is designed to mate in a predetermined manner with die 15. Force applied to punch 14 drives it to mate with die 15, and with workpiece 27 between punch 14 and die 15 as shown, workpiece 27 is changed to the shape dictated by the tooling.

The force applied to punch 14 is provided by cylinder 16 as it receives pressurized fluid at port 26 from pipe or line 45. As a matter of notation or display, dashed lines such as line 45 denote hydraulic lines or pipes. Dotted lines shown in other Figs. denote pneumatic or compressed air lines or pipes. Readers should also note that the press shown in FIG. 1 has been substantially simplified relative to a commercial embodiment which more closely resembles the press shown in the following Figs.

A single operating cycle or power stroke in our invention comprises two distinct phases, a low force first phase in which low pressure hydraulic fluid is provided at port 26 until punch 14 reaches what we call an intermediate position, and a second, high force phase where high pressure hydraulic fluid is applied to port 26. The second phase is not permitted to start until the first phase has completed successfully.

Low pressure hydraulic fluid is provided on line 48 to a valve 38 by a hydraulic fluid source we call a low force actuator advance mechanism 33, and which comprises another part of the actuator assembly. In many but not all cases advance mechanism 33 will comprise a low pressure pump. High pressure hydraulic fluid is provided by a high pressure hydraulic pump or fluid source 35 which comprises another part of the actuator assembly. High pressure fluid flows through line 47 to a valve 42 similar to valve 38. Advance mechanism 33 and pump 35 can have a variety of structures. Where either provides positive pressure hydraulic fluid there are rotary pumps capable of providing fluid of adequate pressure. But for the relatively small amount of pressurized fluid which operates cylinder 16, it is more efficient to use as a pump, a separate cylinder operating in a pump mode and to whose piston force is applied. A bicycle tire pump is an example of this type of pump. It is even possible to have a single high pressure pump which functions as both advance mechanism 33 and pump 35, and whose high fluid pressure is dropped by a throttling valve of some type to provide the low pressure fluid on path 48.

Valves 38 and 42 are operated in a way allowing the apparatus of FIG. 1 to operate in the mode implementing the invention. The open or closed state of valves 38 and 42 is preferably electrically or pneumatically controlled by signals carried by paths 39 and 40 which are applied to what is shown as "O" and "C" control points of valves 38 and 42. The state of a valve 38 or 42 is dictated by the most recent signal applied to its O and C points. That is, each valve 38 and 42 operates in a way similar to that of an electronic flip-flop in that the current state of a valve 38 or 42 is set by the most recent control signal received at its O or C point. For example, if valves 38 and 42 are electrically controlled, a voltage pulse on path 39 causes valve 38 to open and valve 42 to close. A later similar pulse on path 40 causes valve 38 to close and valve 42 to open. We assume that operating or actuation time of valves 38 and 42 is small compared to the operations of cylinder 16 controlled by these valves. In point of fact, valves 38 and 42 can be replaced by switches or other controls which cause mechanism 33 and pump 35 to operate when the associated valve is to be opened. With such an arrangement, check valves or some other mechanisms on lines 48 and 47 are necessary to prevent backflow of pressurized fluid to either mechanism 33 or pump 35 from the other.

A position sensor 25 is operatively connected to punch 14 and the end of rod 23 to detect the position of punch 14 relative to die 15. When piston 19 reaches a preselected position within bore 22, sensor 25 provides a continue signal on path 40. The preselected position of piston 19 corresponds to a preselected intermediate position of punch 14 relative to die 15. In FIG. 1 sensor 25 is shown adjacent to cylinder walls 21 so as to detect the position of piston 19, which of course is directly connected to piston rod 23 and through it, to punch 14. There are a variety of devices which can detect the position of piston 19, the rod 23 end, and punch 14. For the sake of generality we show a sensor 25 in FIG. 1 which directly detects piston 19 position, but our preferred embodiment uses a different mechanism which we show in FIGS. 2–6. Showing sensor 25 as in the form of FIG. 1 makes the point that there are a variety of functionally equivalent solutions to detecting position of punch 14, and more to the point, detecting when punch 14 reaches the intermediate position defined for it. The position-sensing mechanism chosen for a particular system should cooperate and integrate well with the other components of the system.

As mentioned above, the apparatus of FIG. 1 is substantially simplified in a number of ways so as to allow the invention to be described broadly. One of these simplifications is the absence of any means to reset the apparatus to the ready state shown in FIG. 1. In FIG. 1, the press is ready for a complete operating cycle with both valves 38 and 42 closed and piston 19 in its retracted position. The position of piston 19 and the status of valves 38 and 42 change during an operating cycle, and these must be restored to the ready state prior to the start of an operating cycle. The reset functionality is not a part of the invention, and we expect a person of skill in the art to easily add suitable structure to implement the reset actions.

With the apparatus of FIG. 1 in the ready state, a START signal is applied to path 39 which begins an operating cycle. The START signal causes valve 38 to open and valve 42 to close initiating the start of the low force phase of the operating cycle. Low pressure fluid from mechanism 33 flows through valve 38 causing the pressure within pressure chamber 28 to allow piston 19 to move downward away from its retracted position and toward an extended position. This causes punch 14 to approach workpiece 27 and die 15. During this phase of operation, piston 19 and punch 14 move with relatively low force. When punch 14 reaches the preselected intermediate position and piston 19 the corresponding position, sensor 25 provides a continue signal on path 40. This preselected intermediate position of punch 14 occurs between the retracted position and the fully extended position of piston 19 and rod 23. The continue signal causes valve 38 to close and valve 42 to open, starting the high force phase of the operating cycle. High pressure fluid flows through lines 47 and 45 to pressure chamber 28 causing piston 19 to advance toward its fully extended position with relatively high force, pressing punch 14 against workpiece 27 and die 15 and completing the operating cycle. Apparatus not shown detects when there is no further motion of piston 19, at which time a signal is applied to close valve 42. At this point the unshown reset mechanism causes piston 19 to return to its retracted position and the press to return to ready status.

The pressure of the hydraulic fluid provided by mechanism 33 must be great enough to assure that during normal situations, the force applied to piston 19 is sufficient to cause punch 14 to approach workpiece 27 and achieve the intermediate position. Further, the force should be low enough to prevent any serious injury or damage should there be an obstruction, perhaps a relatively fragile obstruction such as a finger, between punch 14 and die 15. The pressure of the hydraulic fluid in line 48 should result in a total force advancing punch 14 in the approximate range of 50–100 lb. or 25–50 kg. This amount of force is adequate in most cases to overcome the friction in the system and move the piston 19 and punch 14 to the intermediate position, and yet not cause serious damage or injury to an obstruction such as a finger or misaligned die 15 or punch 14. A 75 lb. (34 kg.) force applied by piston 19 is roughly equivalent to having one's finger stepped on, definitely uncomfortable but not likely to cause any serious injury. If the obstruction between the punch 14 and die 15 is the operator's finger for example, the finger gets no more than a painful pinch, rather than being severed or crushed.

The majority of the force for advancing a punch 14 having low mass will be provided by low pressure hydraulic fluid from mechanism 33. When dealing with larger presses and heavier punches however, the weight of punch 14 may become significant in calculating the total force present during the approach phase. In these systems, the weight of punch 14 alone may generate force sufficient to cause punch 14 to move toward the intermediate position without any pressurized hydraulic fluid from mechanism 33, in which case mechanism 33 need not pressurize fluid in line 48. In fact, it is entirely possible for a very heavy punch 14 that mechanism 33 will have to operate in what we will call negative pressure mode to retard or oppose the punch-weight generated force with which punch 14 approaches die 15. We include both negative pressure devices such as throttling valves and positive pressure pumps within the definition of mechanism 33 for generally describing our invention. When operating in negative pressure mode, mechanism 33 must maintain an appropriate constant negative pressure so as to limit force buildup on an obstruction which may be present. As a general rule, we prefer punch 14 to approach die 15 with as little force and speed as is needed to allow for reliable and suitably rapid and efficient operation.

Where the combined weight of punch 33, rod 23 and piston 19 is so great that the resultant force urges punch 14 toward die 15 with excessive force, mechanism 33 can comprise a throttling valve. A throttling valve reduces the pressure of fluid flowing through it and meters the rate at which the fluid flows through it. Thus, a throttling valve serving as mechanism 33 provides reduced pressure fluid to the actuator's fluid port. This reduced pressure fluid applies force to the actuator piston opposing the weight carried by the actuator piston, thereby reducing the total force applied by punch 14 to any obstruction which might be present between punch 14 and die 15.

On this point, it is usually preferable to move punch 14 rapidly during the approach phase so that time is not wasted, which would lengthen the entire operating cycle and reduce the production capacity of the press. Heavy punches 14 however, may require a slower approach speed to avoid injury or damage to an obstruction resulting simply from the substantial momentum inherent in a rapidly moving heavy mass. But in most cases, the approach phase is a small percentage of the entire time for a complete press cycle including loading and unloading the workpiece from die 15. Slowing the speed of the approach phase by even 50–75% will not usually create an unacceptable delay. And we recommend skillful tooling design which may sometimes allow shifting of some of the mass from punch 14 to die 15, reducing punch 14 momentum during the approach phase.

Another important parameter for realizing the safe operation of which our press system is capable, is selecting the intermediate position for punch 14 (at which the continue signal issues). The space or gap between punch 14 and die 15 when sensor 25 provides the continue signal should be small enough so that most or all of any potential obstructions prevent piston 19 from moving punch 14 to the intermediate position. In most cases, we feel that 0.25 in. or 1 cm. is a suitable gap between punch 14 and die 15 to define the intermediate position of piston 19. This gap will cause almost any finger trapped between punch 14 and die 15 to prevent punch 14 from reaching its intermediate position, and thus will prevent from occurring, the high force phase which can cause serious injury.

One problem which may on occasion arise when practicing this invention, is dealing with a workpiece 27 which is so thick that when punch 14 is resting on workpiece 27, the gap between punch 14 and die 15 is wide enough to allow a finger to intrude. Creative use of skirting forming a part of the punch 14 or die 15, or even a dense foam band around the periphery of punch 14 or die 15 which is intended to contact an obstruction, may operate to stop punch 14 before it reaches its intermediate position.

Figure 2:
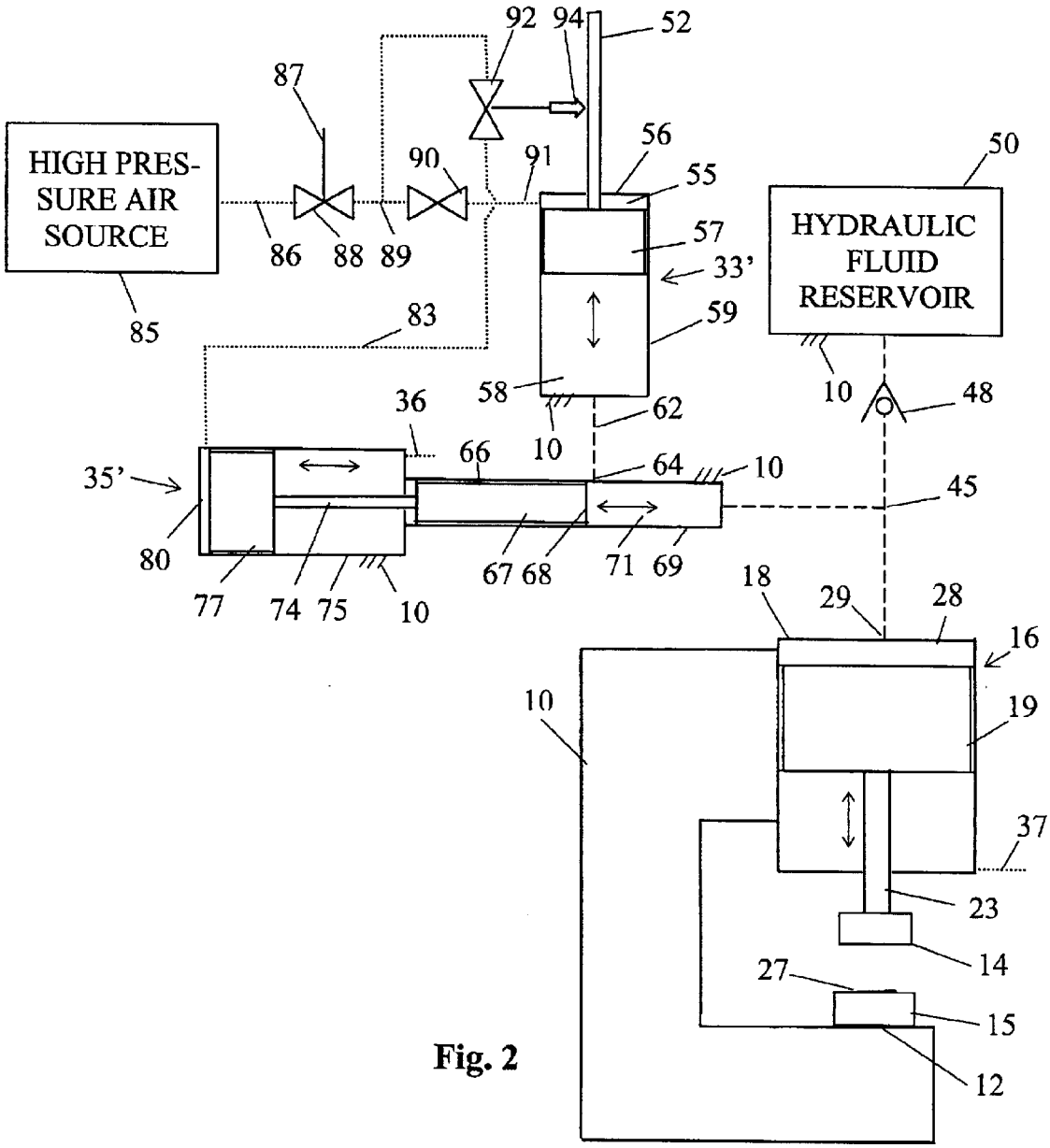
FIG. 2 is a schematic diagram of a preferred embodiment of the invention in a prestart state.
Figure 3:
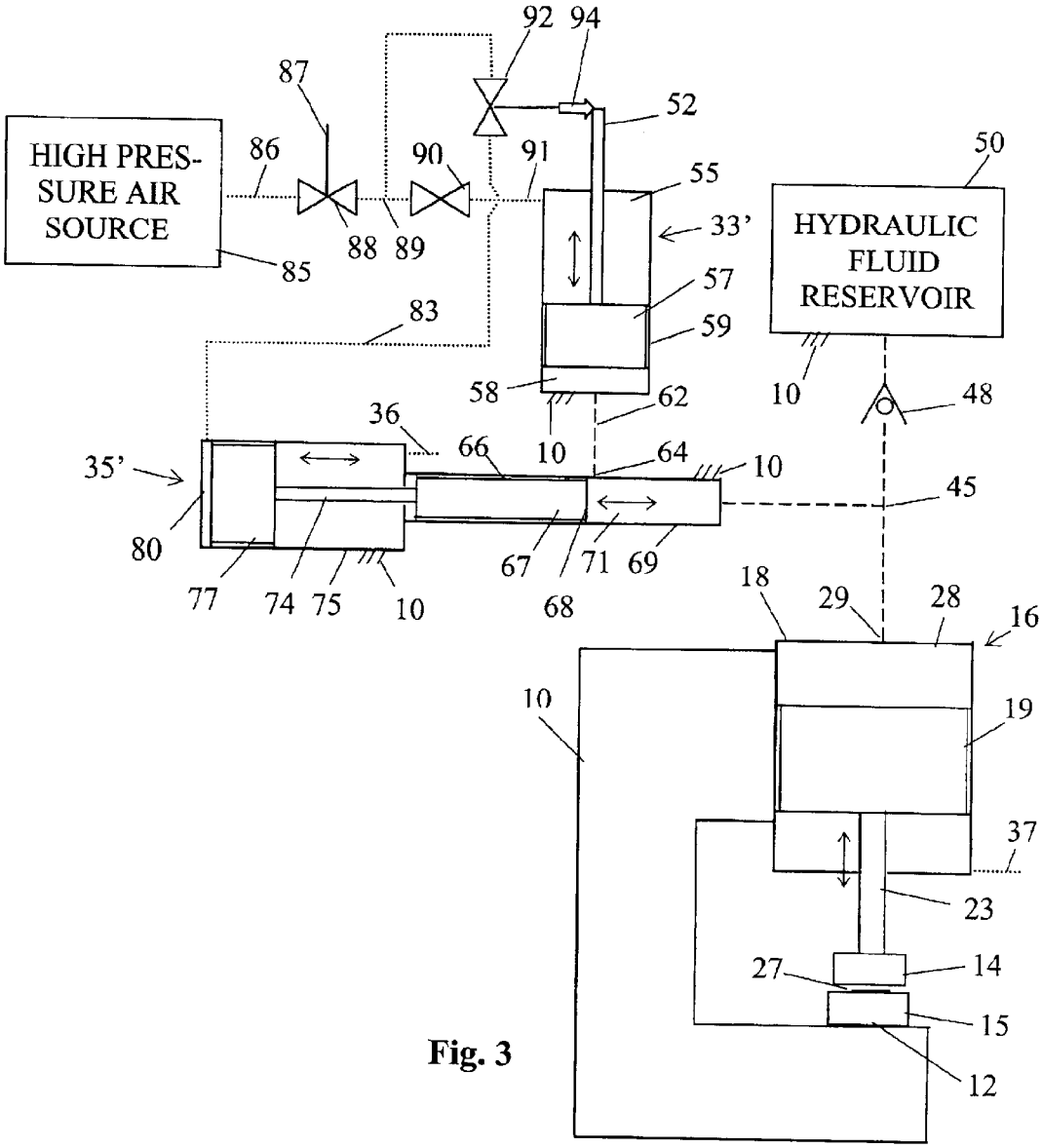
FIG. 3 is a schematic diagram of a preferred embodiment of the invention after the first phase of a power stroke.
Figure 4:
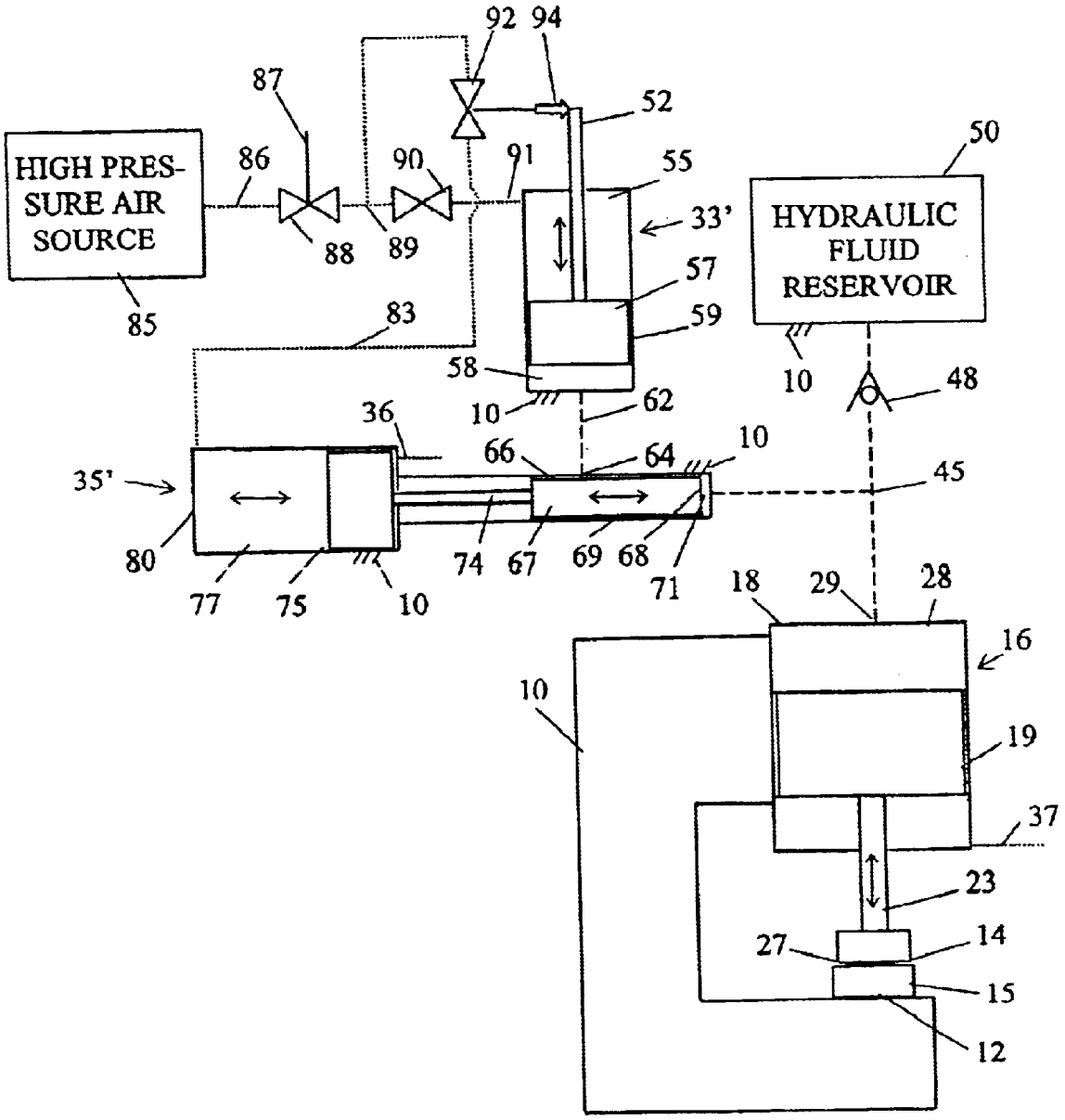
FIG. 4 is a schematic diagram of a preferred embodiment of the invention after the end of a power stroke and before returning to the prestart state.

FIGS. 2–4 show a more complex version of the invention, and incorporate features which we prefer. These Figs. show the system in three stages of progression during an operating cycle. Similar or identical elements in FIGS. 2–4 have reference numbers similar to those in FIG. 1. The punch press itself of FIGS. 2–4 differs little from that of FIG. 1. Only the mechanism for sensing that punch 14 has reached the intermediate position, and line 26 for restoring piston 19 and punch 14 to their retracted or ready position from their extended position are totally different from FIG. 1. As previously mentioned, dashed and dotted lines respectively denote hydraulic and pneumatic lines.

FIGS. 2–4 show pneumatically operated air over hydraulic cylinders serving as advance mechanism 33 and pump 35, and these are indicated at 33' and 35'. Each of the elements of FIGS. 2–4 are typically mounted on C frame 10 as indicated by the frame symbol at 10 on cylinders 33' and 35' as well as on hydraulic fluid reservoir 50. Most of the remaining elements shown in FIGS. 2–4 are also mounted on frame 10. The presentation in FIGS. 2–4 is intended to draw attention to the novel structure of the invention rather than the commercial form, although the commercial form has all of the elements shown. Anyone who is skilled in mechanical design can easily develop a suitable configuration for the elements shown in FIGS. 2–4. The description of FIGS. 2–4 which follows assumes that those skilled in the art are able to calculate pressures and forces generated in hydraulic and pneumatic systems. These have been a part of the art for a long time and the physics is not difficult, so this assumption is reasonable.

Power for operating the system of FIGS. 2–4 is provided by compressed air in our preferred embodiment. However, it is possible that certain lower force presses may permit use of electrical power for pressurizing the hydraulic fluid, perhaps with high pressure gear pumps or rack and pinion actuators. While we show the preferred compressed air operation, electrical power is a viable option as well, and may be considered to be interchangeable with compressed air power.

Compressed air is provided from a high pressure air source 85 typically not mounted on frame 10. Output pressure of source 85 may be in the range of 100–300 psi. or 7 to 21 kg./cm.$^2$. Flow of compressed air to the press system is controlled by an air valve 88 receiving a control signal on path 87. For powering cylinder 33', high pressure compressed air has its pressure reduced to perhaps 30–100 psi. (2–7 kg./cm.$^2$) through a throttling valve 90 which supplies an air line 91. Air over hydraulic cylinder 33' is typical in having two pressure chambers, a pneumatic chamber 55 into which compressed air flows, and a hydraulic chamber 58 which provides pressurized hydraulic fluid, in the case of cylinder 33', at relatively low pressure. Compressed air flows from throttling valve 90 through line 91 into chamber 55 where it applies force to a piston 57 mounted for sliding within cylindrical bore 59. As piston 57 is forced by air pressure within chamber 55 to move down and reduce the volume of chamber 58, low pressure hydraulic fluid flows through line 62 to a port 64 of cylinder 35's pressure chamber 71.

High pressure hydraulic fluid is provided by a compound air over hydraulic cylinder 35' having a pneumatic pressure chamber 80 and a hydraulic pressure chamber 71. Compressed air is provided on line 83 to chamber 80. Compressed air piston 77 slides within wall 75 and provides force to connecting rod 74 as the compressed air in chamber 80 exerts force on piston 77. Cylinder 35' is called compound because force generated by a large diameter pneumatic piston 77 is applied to a small diameter hydraulic piston 67. Piston 67 slides within cylinder wall 69 with the force provided by piston 77 pressurizing hydraulic fluid within chamber 71. Compressed air is provided typically at higher pressure to chamber 80 than to chamber 55, perhaps at line pressure as shown in FIGS. 2–4. The product of the piston 77 face area and the chamber 80 pressure specifies the force applied to rod 74 and piston 67. The force applied to rod 23 equals the force applied to rod 74 times the ratio between the area of the piston 19 face and the area of the piston face 68. Controlling force applied to pressure chamber 80 allows reasonably adequate control of the force piston applies to punch 23 during the power phase.

One important feature of the FIGS. 2–4 system is the mechanism for preventing backflow of high pressure hydraulic fluid from chamber 71 to chamber 58. We prefer that port 64 be located within chamber 71 very close to face 68 of piston 67 when piston 67 is in its totally retracted position as shown in FIG. 2. As piston 67 begins its power stroke, face 68 passes port 64 and wall 66 closes port 64 preventing backflow of hydraulic fluid into chamber 58 from chamber 71.

We also use a novel mechanism to sense the instant when punch 14 reaches the intermediate position. There is a precise relationship between the position of piston 57 and the position of piston 19 during the approach or low force phase of an operating cycle. We find it convenient as well as extremely accurate to sense position of piston 19 by sensing position of piston 57. While we show the sensing and control elements as pneumatic, electrical control is equally suitable. To provide the required control function, a sensing shaft 52 attached to the pneumatic side of piston 57 projects from the end 56 of cylinder 33'. A pneumatic valve or switch 92 receives high pressure compressed air from line 89 and when conducting or open, allowing compressed air to flow to line 83. Valve 92 has a control arm 94 which rides on or otherwise senses the presence of a preselected feature of shaft 52, the shaft end in this embodiment. With shaft 52 in the position shown in FIG. 2, valve 92 is closed or non-conducting, preventing flow of compressed air through valve 92. When shaft 52 advances to the position shown in FIG. 3, control arm 94 shifts due to sensing the shaft 52 end, allowing valve 92 to conduct or pass compressed air to line 83.

Accurate measurement of punch 14 position requires a constant volume of hydraulic fluid in the system comprising compression chambers 58, 71, and 28. Since a certain amount of hydraulic fluid tends to leak from the system during use, a reservoir 50 is provided from which replacement fluid flows through a check valve 48 between operating cycles to keep the system completely filled.

An operating cycle starts with the system in its ready state as shown in FIG. 2 with pistons 57, 67, 77, and 19 all in their retracted positions. Valve 87 is opened allowing compressed air to flow through throttling valve 90 where the pressure is dropped. The reduced pressure compressed air flows through line 91 to chamber 55 of cylinder 33'. This causes piston 57 to move downwards toward its extended position as shown in FIGS. 3 and 4, enlarging pressure chamber 55 and shrinking pressure chamber 58. Hydraulic fluid in chamber 58 flows through line 62 and port 64 to pressure chamber 71, from where it flows to line 45. From line 45, the pressurized fluid flows through port 29 into chamber 28, causing piston 19 to slide away from its retracted position toward die 15. During normal operation piston 57 reaches the extended position shown in FIG. 3, at which point piston 19, connecting rod 23, and punch 14 all have reached their intermediate position. Simultaneously with punch 14 reaching the intermediate position, control arm 94 detects the end of sensing shaft 52 as piston 57 slides into chamber 58. At this point valve 92 opens, allowing high pressure compressed air to flow to chamber 80. Piston 77 slides rightwardly from its retracted position shown towards its extended position, sliding piston 67 rightwardly as well. A volume of high pressure hydraulic fluid flows from chamber 71 through line 45 to pressure chamber 28. This constitutes the second, high force phase of an operating cycle. Piston 19 slides from its intermediate position toward its extended position under the influence of the high pressure hydraulic fluid flowing into pressure chamber 28. The change in volume of chamber 28 during this second phase of the operating cycle very nearly equals the change in the volume of chamber 71. Punch 14 is forced against workpiece 27 and die 15 to perform the machining of workpiece 27 and complete the operating cycle. The operating cycle is complete when piston 19 has reached its extended position and die 14 is stopped. Stopping of die 14 can be detected in a number of ways, for example by detecting air flow through line 37 from the chamber below piston 19.

After the second, high force phase of the operating cycle is complete, the reset phase begins. As mentioned above, this is relatively well known. A simple mechanism for the reset function is providing compressed air to lines 36 and 37 to force pistons 19 and 77 to the retracted positions shown in FIG. 2. We find that it is possible to restore piston 57 to its retracted position as well by continuing compressed air flow in line 37 after piston 77 has reached its retracted position where port 64 is uncovered.

Should punch 14 encounter an obstruction during an approach phase, the low force producing motion of punch 14 causes advance of punch 14 to stop, and before the intermediate position has been reached. The system essentially halts, frozen in that position. In this simplified position, the operator will have to remove the START signal from control path 87. This closes valve 88 and removes power from cylinders 33' and 35'. At this point the operator will be able to safely remove the obstruction whatever it is. Of course, inserting anything other than workpiece 27 in the space between punch 14 and die 15 is risky, and should not be done.

Figure 5:
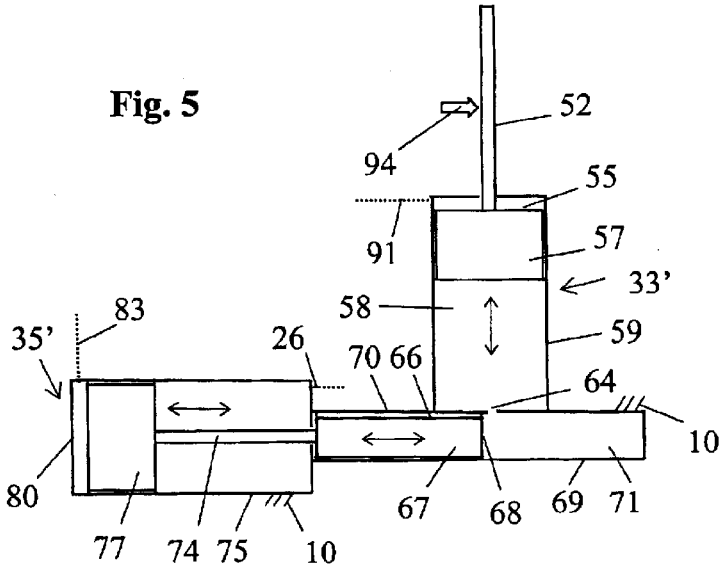
FIGS. 5 and 6 show a schematic preferred embodiment of a particular feature of the invention.
Figure 6:
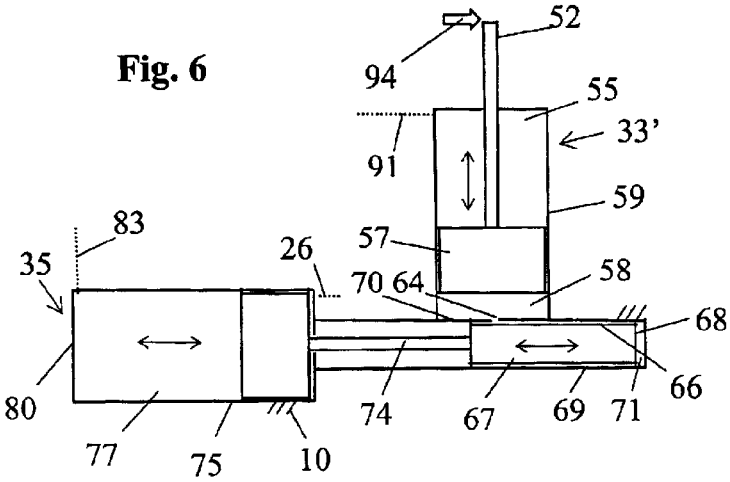

FIGS. 5 and 6 show an integrated structure for cylinders 33' and 35' with pressure chambers 58 and 71 sharing a common wall 70. Line 62 has been eliminated and port 64 is in wall 70. In the ready position shown in FIG. 5 and which corresponds to FIG. 2, port 64 is uncovered by piston 67. In FIG. 6, which corresponds to FIG. 4, the high force phase is complete, with port 64 covered by piston wall 66 shortly after piston 67 starts its motion.

Figure 7:
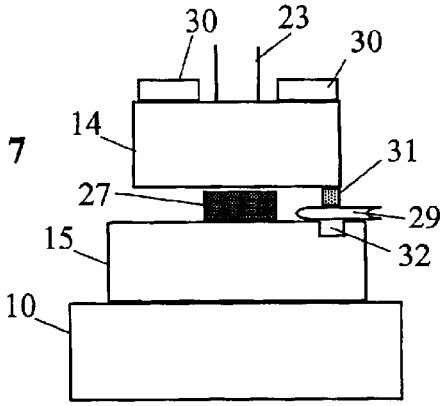

FIG. 7 shows some alternatives which may be useful in certain press systems. For situations where punch 14 may be able to provide with its own weight, all of the force required to advance itself toward die 15 without positive force from mechanism 33, it is possible to add weights 30 to punch 14. These weights 30 may be add-ons or even integral with the rest of punch 14. The idea here is to weight punch 14 sufficiently to provide the preferred 50–100 lb. net amount of force for advancing punch 14 toward die 15 during the approach phase.

Figure 8:
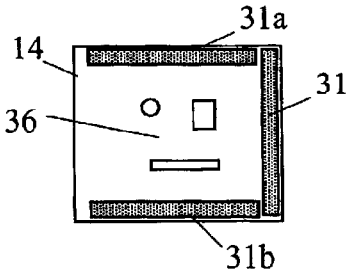
FIGS. 7 and 8 show a schematic diagram of a preferred means for detecting obstructions.

Another feature of this invention shown in FIGS. 7 and 8, solves a problem which arises with a relatively thick (tall) workpiece 27. A thick workpiece 27 may create a situation where punch 14 contacts workpiece 27 before the possibility of an obstruction between punch 14 and die 15 has been completely eliminated. While it may not be possible or at least easily possible to detect the punch 14-die 15 misalignment type of obstruction, it may be possible to detect presence of some types of objects forming obstructions when thick workpieces 27 are involved. Specifically, it may be possible to detect presence of a hand or finger 29 (FIG. 7), in the space between punch 14 and die 15. We do this by using a resilient strip 31 attached to the operating face of punch 14. In FIG. 7, a single resilient strip 31 is shown in end view. In FIG. 8, three resilient strips 31, 31*a*, and 31*b* are shown attached to the operating face of punch 14 along three sides thereof. Strip 31 should face the operator directly. This arrangement of strips in FIG. 8 will detect most obstructions which are operators' hands or fingers and most likely to be inserted from the front or sides of punch 14. For improved perspective, a representative pattern 36 of tooling is shown as well.

It is possible to mount strip 31 on the die 15 as well as on punch 14. Functionally, both arrangements should be equivalent.

Should a finger or hand 29 be in the space between punch 14 and die 15, at the start of an operating cycle, the approach phase will bring strip 31 into contact with the finger or hand 29 before punch 14 reaches its intermediate position. Strip 31 should have sufficient stiffness or density when pressing against a finger or hand to resist further motion of punch 14 and prevent punch 14 from reaching its intermediate position. High density foam or soft rubber such as that used in pencil erasers will often be suitable. Specifically, the material comprising strip 31 may preferably be of the type which will deflect approximately 0.01 to 0.1 in. (0.25 to 2.5 mm.) when pressing against 0.1 in.$^2$ of an obstruction surface with 50 lb. force. The important factor in this selection is to avoid serious injury to a finger or hand and yet be able to easily resist movement of punch 14 during the first phase of the operating cycle with little compression of the strip material.

In order to prevent substantial changes in the height dimension of a strip 31 during normal operation, a slot or groove 32 may be provided in die 15 with which strip 31 mates during the high power phase. Strip 31 will deflect slightly when encountering an obstruction but will still provide adequate resistance to further advancing of punch 14. Most importantly, the pressure which is applied to a finger caught between the die 15 and strip 31 by even, say 100 lb. of force advancing punch 14, will not cause serious injury.

We claim:

1. A method for operating a press, wherein the press includes a frame, a table mounted on the frame for supporting a workpiece, a hydraulic actuator mounted on the frame, an actuator piston sliding within an actuator bore, and an actuator piston rod attached to and projecting from the actuator piston toward the table, wherein the actuator piston rod has an end for transferring force from the actuator piston to the workpiece, said actuator piston defining between itself and an end of the actuator bore an actuator pressure chamber, said actuator having a fluid port in flow communication with the actuator pressure chamber, and said actuator piston moves between a retracted position, at which the piston rod end is retracted from the table, and an extended position, at which the piston rod end is adjacent to the table, the method comprising:

a) supplying relatively low pressure fluid to the actuator's fluid port in response to a start signal, wherein the pressure of the low pressure fluid is such that a light obstruction such as a human finger can block movement of the actuator piston;

b) sensing the position of the actuator piston rod end, and providing a continue signal in response to the actuator piston rod end achieving a predetermined spacing from the table between the retracted and extended positions of the piston rod end relative to the table, wherein blocking of the actuator piston by the light obstruction before the predetermined spacing is reached will prevent the continue signal from being sent; and c) supplying relatively high pressure fluid to the actuator's fluid port in response to the continue signal, wherein the supplying includes pumping the low pressure fluid with a low-pressure supply piston, and the method includes performing the sensing of the piston rod end by sensing a physical feature of the low-pressure supply piston.

2. A method of operating a press having a frame, a table mounted on the frame for supporting a die of a tooling set on which may be placed a workpiece, a drive rod mounted on the frame to move toward and away from the table between retracted and extended positions respectively, wherein the drive rod has an end adjacent the table for carrying a punch of a tooling set, and said drive rod is for transferring force to the punch, the method comprising:

a) providing relatively low force to the drive rod responsive to a start signal, said low force urging the drive rod toward the table, wherein the low force is such that movement of the drive rod is blocked if a human hand or finger interferes with the drive rod;

b) sensing the position of the drive rod, and providing a continue signal in response to the drive rod achieving a predetermined position between the retracted and extended positions of the drive rod;

c) supplying relatively high force to the drive rod in response to the continue signal;

d) generating force to apply to the drive rod with a force generator; and e) performing the sensing of the position of the drive rod by sensing a position feature of the force generator, wherein:

the force generator includes a low pressure hydraulic cylinder having an internal piston, said low pressure hydraulic cylinder supplying low pressure hydraulic fluid;

the position feature comprises a sensing shaft attached to the piston and projecting from the low pressure hydraulic cylinder;

the force generator comprises an actuator hydraulic cylinder receiving low pressure hydraulic fluid from the low pressure hydraulic cylinder; and the sensing of the position of the drive rod further comprises sensing the position of the sensing shaft.

3. A method for operating a punch press comprised of a punch designed to mate in a predetermined manner with a die for forming a workpiece, the method comprising:

supplying a low pressure hydraulic fluid via a low pressure valve to a fluid port operatively connected to the punch for applying a relatively low force to the punch in accordance with a start signal, wherein the low pressure valve is in an open state, wherein the low force is too low to cause injury if a human hand or finger interferes with the punch;

detecting if the punch has reached a predetermined intermediate position and generating a continue signal if the punch has reached the predetermined intermediate position, wherein the predetermined intermediate position is such that a human finger located between the punch and the workpiece will apply force to the punch before the punch reaches the predetermined intermediate position; and supplying a high pressure hydraulic fluid via a high pressure valve to the fluid port for applying a relatively high force to the punch in accordance with the continue signal, wherein the high pressure valve is in the open state and the low pressure valve is in a closed state, wherein:

the supplying of the low pressure hydraulic fluid further comprises moving a low pressure piston within a low pressure chamber;

the detecting of if the punch has reached the predetermined intermediate position and generating a continue signal if the punch has reached the predetermined intermediate position further comprises detecting the end of a sensing shaft attached to the low pressure piston as the low pressure piston moves within the low pressure chamber for detecting if the punch has reached the predetermined position and placing a valve operatively connected to the low pressure piston in an open state when the end of a sensing shaft is detected for generating the continue signal; and the supplying of the high pressure hydraulic fluid further comprises driving a high pressure piston within a high pressure chamber.

4. The method of claim 3, further comprising attaching a strip of resilient material to an operating face of the punch or the die for causing an obstruction to apply force to the punch before the punch reaches the predetermined intermediate position.

5. The method of claim 3, wherein the supplying of the low pressure hydraulic fluid further comprises supplying the low pressure hydraulic fluid as a negative force with respect to a weight of the punch for applying the relatively low force.

6. A method of operating a hydraulic press, wherein the press includes a hydraulic piston chamber, an actuator piston accommodated in the hydraulic piston chamber, and a tool fixed to the actuator piston, wherein the method comprises:

in a first stage of operation, supplying fluid at a relatively low pressure to the hydraulic piston chamber in response to a start signal, wherein, in the first stage of operation, the fluid applies a force to the actuator piston that is low enough that a human hand or finger applied to the tool can block movement of the actuator piston;

sensing the distance between the tool and a workpiece;

providing a continue signal when the tool is spaced from the workpiece by a predetermined distance;

in a second stage of operation, supplying fluid at a relatively high pressure to the hydraulic piston chamber in response to the continue signal to perform a pressing operation on the workpiece, wherein the method further comprises:

supplying the fluid to the hydraulic piston chamber with a low-pressure pump piston; and performing the sensing of the spacing between the tool and the workpiece by detecting the actual position of the low-pressure pump piston.

7. A method of operating a hydraulic press, wherein the press includes a hydraulic piston chamber, an actuator piston accommodated in the hydraulic piston chamber, and a tool fixed to the actuator piston, wherein the method comprises:

in a first stage of operation, supplying fluid at a relatively low pressure to the hydraulic piston chamber in response to a start signal, wherein, in the first stage of operation, the fluid applies a force to the actuator piston that is low enough that a human hand or finger applied to the tool can block movement of the actuator piston;

sensing the distance between the tool and a workpiece;

providing a continue signal when the tool is spaced from the workpiece by a predetermined distance;

in a second stage of operation, supplying fluid at a relatively high pressure to the hydraulic piston chamber in response to the continue signal to perform a pressing operation on the workpiece, wherein the method further comprises:

supplying the fluid to the hydraulic piston chamber with a low-pressure supply piston; and driving the low-pressure supply piston pneumatically.

8. The method of claim 7 further comprising attaching a strip of resilient material to an operating face of the tool or a die that is opposed to the tool for causing an obstruction to apply a force to the tool and to block movement of the tool during the first stage of operation, thus preventing the second stage of operation.

9. The method of claim 7 further comprising preventing the second stage from being performed if a foreign object obstructs the tool.

10. The method of claim 7 further comprising delivering the high-pressure fluid and the low-pressure fluid to a single port of the hydraulic piston chamber.

11. The method of claim 7 wherein the predetermined distance is such that a human hand or finger located between the tool and the workpiece will apply force to the tool and block the tool before the workpiece is spaced from the tool by the predetermined distance.

12. The method of claim 7 wherein, in the first stage of operation, the method includes supplying the low pressure fluid from a low pressure fluid source, and in the second stage of operation, the method includes supplying the relatively high pressure fluid from a high pressure fluid source, which is separate from the low pressure fluid source.

13. The method of claim 12 wherein the method includes pneumatically driving the low pressure and high pressure fluid sources.

* * * * *